US012459602B2

(12) United States Patent
Greer

(10) Patent No.: US 12,459,602 B2
(45) Date of Patent: Nov. 4, 2025

(54) TRUSS-SUPPORTED SKI-BORNE WATERCRAFT

(71) Applicant: Richard R. Greer, Peoria, AZ (US)

(72) Inventor: Richard R. Greer, Peoria, AZ (US)

( * ) Notice: Subject to any disclaimer, the term of this patent is extended or adjusted under 35 U.S.C. 154(b) by 564 days.

(21) Appl. No.: 17/942,162

(22) Filed: Sep. 11, 2022

(65) Prior Publication Data

US 2024/0083546 A1 Mar. 14, 2024

(51) Int. Cl.

| | |
|---|---|
| ***B63B 1/24*** | (2020.01) |
| ***B63B 1/26*** | (2006.01) |
| ***B63B 1/32*** | (2006.01) |
| ***B63H 1/14*** | (2006.01) |
| ***B63H 11/00*** | (2006.01) |
| ***B63H 25/06*** | (2006.01) |

(52) U.S. Cl.

CPC ..... *B63B 1/242* (2013.01); *B63B 1/246* (2013.01); *B63B 1/248* (2013.01); *B63B 1/26* (2013.01); *B63B 1/322* (2013.01); *B63H 1/14* (2013.01); *B63H 11/00* (2013.01); *B63H 25/06* (2013.01)

(58) Field of Classification Search

CPC .... B63B 1/00; B63B 1/16; B63B 1/18; B63B 1/20; B63B 2001/183; B63B 2001/186; B63B 1/24; B63B 1/242; B63B 1/246; B63B 1/248; B63B 1/26; B63B 1/32; B63B 1/322; B63B 11/00; B63B 25/06; B63H 1/14

USPC ..... 114/271, 274, 278, 283, 292

See application file for complete search history.

(56) References Cited

U.S. PATENT DOCUMENTS 5,359,958 A * 11/1994 Guild ..... B63B 1/16 114/274
5,619,944 A * 4/1997 Baker ..... B63B 1/042 114/283
5,676,087 A * 10/1997 Baker ..... B63B 1/042 114/283

* cited by examiner

*Primary Examiner* — Daniel V Venne
(74) *Attorney, Agent, or Firm* — Bycer & Marion, PLC; Matthew L. Bycer

(57) ABSTRACT

A truss-born watercraft supported above at least two, preferably three, planing skis. An outboard motor may be positioned within or above one or more of the skis to provide propulsion. A freight or passenger compartment may be secured and/or supported by the truss members above the water line. As the watercraft hits a cruising speed, skis are lifted above the water level allowing planning of skis and extreme improvement in mobile efficiency.

16 Claims, 9 Drawing Sheets

TRUSS-SUPPORTED SKI-BORNE WATERCRAFT

TECHNICAL FIELD

The present disclosure relates to watercraft systems. The present invention more particularly relates to watercraft borne on planing skis.

BACKGROUND

Watercraft of all types must contend with various hydrodynamic principles. Energy efficiency is often a driving aspect of design, as more efficient watercraft generally consume less fuel. More efficient systems require less powerful propulsion to achieve desired performance metrics, and thus are generally cheaper to build, operate, and/or maintain.

One approach to improving watercraft efficiency is to mount lifting surfaces to the craft, often known as hydrofoils. In principle, when the watercraft is propelled forward, the lift surfaces produce lift, thus raising the watercraft at least partially out of the water, reducing the portion of the body of the craft that is in contact with the water. This generally reduces hydrodynamic drag, enabling the craft to operate at greater efficiencies. Typical drawbacks with the hydrofoil approach relate to design complexity and scenarios wherein the craft is operated at relatively lower velocities or while stationary; without the lift surfaces producing sufficient lift, the craft will settle deeper into the water, exposing the necessary support structure to drag forces. Hydrofoil-based watercraft are often less hydrodynamically efficient than more typical designs when not operating at velocities sufficient to result in enough lift to raise the body of the craft.

BRIEF DESCRIPTION OF THE DRAWINGS

Features and advantages of various embodiments of the claimed subject matter will become apparent as the following Detailed Description proceeds, and upon reference to the Drawings, wherein like numerals designate like parts, and in which:

DETAILED DESCRIPTION

Figure 1:
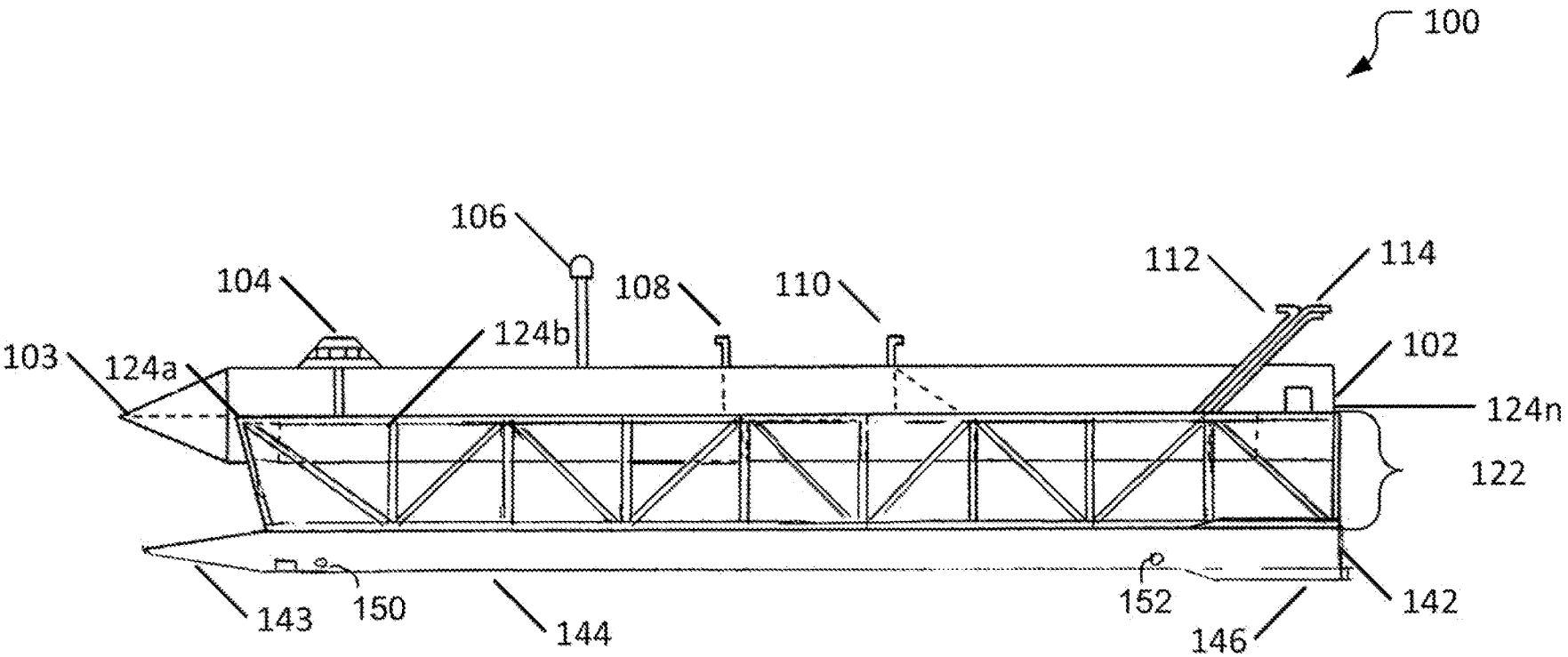
FIG. 1 illustrates a side plan view of a ski-borne freight watercraft consistent with at least one embodiment of the present disclosure.

The systems and methods disclosed herein provide a ski-borne watercraft with improved performance and stability. The floating craft, a watercraft, is designed to minimize weight and enhance performance. Certain items require special attention for weight sensitivity. (Multiple) floating skis, trusses along the one or more skis, the stiff frame created when a truss is connected to the adjacent truss along the horizontal truss member at the top of each truss vertical member via a truss connecting member. Preferably one-third down each vertical member, another tube, or truss connecting member, will be connected to the parallel piece on the adjacent truss. The truss connecting tubes are preferably made of the same material as the top, bottom, and vertical members of the trusses. Further, the one or more bodies set between the trusses may be positioned to rest on the truss connectors, potentially the top one-third of the height of the truss verticals (preferably the trusses pass through the body or are otherwise affixed mechanically thereon/therethrough). Finally, the power system should be lightweight.

As a non-limiting example, a system consistent with the present disclosure may include a body or bodies for housing persons or supplies, a truss structure connected or holding the body or bodies, and one or more floating skis connected to the truss structure. Preferably, the top surfaces of the skis may be connected to the bottom or underside of the truss structure. Forward motion of the system along the surface of a body of water may allow the skis to generate lift. Depending upon velocity, the skis may generate sufficient lift as to enable the skis to plane, or skim, along the surface of the body of water, depending upon speed. Skis may temporarily pitch (bow up/stern down) drawing more initial lift prior to planing, wherein surface tension forces may add to lift.

Example systems may be any of a variety of sizes and thus serve a variety of functions; for example, in some embodiments the watercraft may be as small as a single-passenger vessel with a length overall (*LOA*) of less than twenty-five feet, preferably around thirty feet. In other embodiments, the watercraft may be a 500+ passenger vessel with a length-overall (*LOA*) of well over one hundred feet.

In one embodiment, a horizontal truss connector beam passes through the body to attach one vertical truss member to an adjacent vertical truss member. Top (horizontal) truss connectors may be used to support a floor in the body, either at the bottom of the body, or when dividing the body into two levels, supporting the upper level, or other like support. The first four segments may be designed to consider structural load on truss. It is important to note that the ski and truss form an upside-down 'T' structure, when securely fastened at numerous places where the truss contacts the ski. Each truss and ski adds to the rigidity, stability, and strength of the other. Cross braces set along a horizontal plane may be used to connect the truss structure at vertical members, preferably within the lower two-thirds of the truss structure, and bind with the vertical struts and thereby bind the other trusses (related with each ski) together. Cross braces may be supplied in an X-form at forty-five-degree angles from bow/stern, intersecting one another at ninety-degree angles.

In one embodiment, power may be provided by diesel engines powering electric generators located in the center of the craft, between the two bodies (for proper weight distribution). Electric power cables may pass inside the aft truss and/or vertical strut members through the skis and pod structure to the electric motors powering the water jet pumps. Cooling and fresh air may be furnished to the jet pump pods as per design requirements, either through outlets or slats. A passenger version of the craft (e.g. shown below in FIG. 5) may utilize a marine gas turbine to power one or more water jet pumps.

FIG. 1 illustrates a side plan view of a ski-borne watercraft 100 consistent with at least one embodiment of the present disclosure. The embodiment shown in FIG. 1 is similar to a passenger or freight vehicle of the large (one hundred+ foot LOA) craft. Watercraft 100 generally includes at least one body 102, truss structure 122 and ski 142. Watercraft 100 may include multiple bodies, truss structures, and/or skis, depending upon embodiment, as will be demonstrated below with reference to top elevation view of FIG. 2. Watercraft 100 may additionally include components commonly known in the art, such as a cabin 104, electronic communication array 106 (e.g., radar, GPS, etc.), engine room air intake 108, engine room air exit 110, diesel air intake 112, diesel exhaust 114, etc., affixed between or aside bodies 102 as shown in FIG. 1. Watercraft 100 may include at least one motor 146. Motor 146 may be mounted to ski 142 to enable application of thrust to watercraft 100. Thrusters 150 (stern) and 152 (aft) may be set alongside outer side of ski 142 or set therethrough to assist in docking via port/starboard thrusting. Ski tip 143 may provide an angled engagement with the water, and ski bottom 144 may be used for planing on a surface of water. Truss members 124*a*-124*n* may include vertical struts and/or slightly off vertical members.

Body 102 may be made of any of a plurality of light materials, as will be understood by those skilled in the art. For example, body 102 may be made of fiberglass, steel, aluminum, etc. Body 102 may have a generally aerodynamic shape with a tapered front end 103, as shown in FIG. 1. Weight of body 102, tubular trusses, truss connectors and skis 142 have a similar impact on this performance. Skis 142 may be set with a height approximately one-third the height of truss. In some embodiments, it may be preferable for the ski to be submerged 25%, 50%, or 75% in water loaded and at rest, but preferably not more than 80% submerged.

In the most preferred embodiments, the total weight of the watercraft, empty or when loaded, will be considered in the calculation of the size (width, length, and height) of the floating skis. It is preferred that the amount of fluid/water displaced by the skis (or more preferably a portion thereof) is of a weight equivalent to the craft. In such a way, at rest, the skis will be partially submerged, while maintaining the top of the skis, the truss structure, and the body above water. In one exemplary embodiment for a small passenger vehicle, the skis may be twenty seven inches wide by thirty-two feet long by one foot high, providing a two hundred sixteen cubic foot (cf) volume. Skis, if fully submerged, may displace approximately 13,824 pounds of fluid (considering a value of 64 lbs/cf for sea water). The vehicle weighing approximately eleven thousand pounds (when fully loaded) may result in an approximate 75%-80% submersion at rest.

Truss structure 122 is generally comprised of a plurality of truss members 124, e.g., 124*n*, or members, and/or webbing, which are comprised of a relatively lightweight material, such as structural tubular aluminum, tubular steel, fiberglass, resin-based composite material, carbon fiber, etc. In smaller embodiments, the truss structure may be made from a hollow welded thermoplastic, PVC, polypropylene, PP-R, PP-RP (RCT), or structural aluminum or steel tubing or possibly polyvinyl thick-walled water pipe. A fitting or truss other type of piping. Pipes may form the truss and may be thermo-coupled to joints or directly onto skis.

Truss structure 122 may be any of several truss designs, such as, for example, a common pitched truss, a Pratt truss, a lattice truss, a space frame truss, etc. In a preferred embodiment, truss structure 122 may include a common pitched truss including alternating diagonal members, as shown in FIG. 1. While FIG. 1 depicts thirty vertical struts, truss structure 122 may include any of a plurality of strut counts, such as eighty struts or fewer, twenty struts or fewer, or, in some embodiments, one hundred-fifty struts or greater. This is because some embodiments may include multiple truss structures, and some embodiments may generally be larger than others; in general, larger embodiments (measured by, for example, LOA) require more expansive truss structures that may include triangular support or other geometry along the length of the truss. Between each ski, a matrix of all truss members is provided. Preferably the craft may include two to three skis. When multiple skis are included, one ski may be positioned starboard relative to another ski. Larger embodiments utilized for mass transportation or cargo may require three or more full-length skis.

A truss support point 281 may be level with the top of the truss where the vertical strut joins the top truss connector (TC), TC as horizontal truss (preferably tube) members may pass through the body to connect with adjacent vertical struts. Horizontal truss connector members 125 may be parallel to the water surface or may be set at an angle other than that of the water surface. Horizontal truss connector members 125 may join adjacent truss members. The truss support point 281 may be preferably located one-third of the way down from the top of the truss to the top of the lower TC attached to the adjacent truss. For example, as shown on FIGS. 6-7, a total of twelve TCs 625 connect center truss 622*b* to starboard truss 622*c*, and twelve connect port truss 622*a* to center truss 622*b*. This structure forms a stiff box frame platform structure. This structural configuration forms a stiff, strong form that remains flat and is not subject to exceptional twisting, bending, or warping. The flat strap 627 that may be made of aluminum, steel, or other material may be set along the sides of each ski attached to the structural framework. Horizontal X-braces or cross-braces may be used on the lower two-thirds of the truss to connect vertical struts, to provide stability if needed. In the passenger and/or freight embodiments, the bodies rest on the lower horizontal truss members, and the top of the truss is preferably penetrating and passing through the middle of each body (supporting a middle floor, if needed).

Ski 142 is similarly connected to truss structure 122 at a plurality of joints (not labeled in FIG. 1). In operation of watercraft 100, ski 142 may generally remain in contact with a body of water over which watercraft 100 may travel. Ski 142 may be generally longitudinal, in that a central axis of ski 142 may be generally parallel to the central axis of watercraft 100. Due to the hydrodynamic shape of ski 142 (including ski tip 143), ski 142 may apply a lift force to truss structure 122 and thus in turn to body 102 of watercraft 100. This lift force is directly correlated to the velocity of watercraft 100 relative to the body of water. The exact relationship between velocity and lift may vary depending upon the embodiment, but in one example embodiment, the force is approximated according to Equation 1:

$$F=1.28*\rho_a/V^2$$

Where

ρ=density of salt water (64.0 lbs/ft$^3$ or 1.989 slugs)

a=area of flat plate (ft$^2$)

V=velocity (ft/sec)

The fixed constant, 1.28, represents the turbulence about the free edges of the flat plate.

Where the flat plate is at an angle other than perpendicular to the water stream, the force (F') acting upon the flat plate may be separated into a lift and a drag component by the following formulae after multiplying the force (F) by the sine of the angle (sin Θ), or F'=(sin Θ)*F $$\text{Lift } (L)=F\cos\Theta, \text{ or } F\sin\Theta\cos\Theta$$

$$\text{Drag } (D)=F'\sin\Theta, \text{ or } F\sin^2\Theta$$

Where Θ=0.1°, $$L=\tfrac{1}{2}pV^2a\cos(0.1°)\sin(0.1)°$$

$$\text{and } D=\tfrac{1}{2}pV^2a\sin 0.1°$$

If one assumes the speed of watercraft to be 30 mph, or V=44 ft/sec, then $$L=(0.5)(1.989)(44)^2*a*(1)(0.00175)=3.37\ a \text{ lbs}$$

$$\text{and } D=(0.5)(1.989)(44)^2(0.00175)a=3.37\ a \text{ lbs}$$

The power required to overcome the drag (D) is $$\text{Power}=((\text{Drag})(a)(\text{Velocity}))/550=((3.37)(44)a)/550=0.27\ a \text{ H.P.}$$

Where the watercraft has a lower surface area of 192 ft, the power required is:

$$\text{Power}=(0.27)*(192)\text{H.P.}=51 \text{ H.P.}$$

and it will generate a lift equal to:

$$\text{Lift}=(3.37)(192) \text{ lbs}=647 \text{ lbs of lift}$$

As can be seen, as the angle Θ approaches 0, the Power required to lift the vehicle drops. As the angle increases, substantially less power may be required to power the vehicle. Once planing close to 0.1 degrees, the energy required to propel the vehicle substantially drops.

At Θ=0.5 degrees, Lift=3,228 lbs of lift, Power=263 H.P.

At Θ=0.4 degrees, Lift=2,588 lbs of lift, Power=207 H.P.

At Θ=0.3 degrees, Lift=1,937 lbs of lift, Power=155 H.P.

At Θ=0.2 degrees, Lift=1,294 lbs of lift, Power=103.5 H.P.

At Θ=0.1 degrees, Lift=647 lbs of lift, Power=51 H.P.

In some embodiments, ski bottom 144 of ski 142 is generally planar. However, in some embodiments, ski bottom 144 may include some degree of curvature, for example near ski tip 143, ski 142 may be angled in order to penetrate small waves. Additionally, in some embodiments, ski bottom 144 may include an applied coating of one or more low-drag materials to further reduce hydrodynamic drag enacted upon ski 142 and to otherwise deter or counteract marine growth inhibiting movement through the water. Ski tip 143 may be generally curved, rounded, or pointed so as to reduce overall wind resistance and assist in wave penetration.

In some embodiments, ski 142 may connect to two truss structures rather than one. For example, rather than a single truss 122, watercraft 100 may include multiple truss structures. This may improve stability, particularly for larger embodiments of watercraft 100.

Ski 142 may be hollow or solid. For example, in some embodiments, ski 142 may include a hollow aluminum section, wherein space inside ski 142 may house components such as fuel, motor 146, or water ballast to improve stability. When liquids, fuel, water, or otherwise, serve as ballast, a pump may be used to move liquid forward/backward within the skis to maintain stability and assist in operation and motion of watercraft 100. In other embodiments, ski 142 may be a solid structure (such as fiberglass). In general, larger embodiments of watercraft 100 may be more likely to benefit from a hollow ski 142, but embodiments wherein smaller (e.g., small passenger) watercraft 100 include hollow skis and embodiments wherein larger watercraft 100 (LOA of one hundred feet or greater, capacity for five hundred or more passengers, etc.) include solid skis are fully considered herein.

Ski 142 may further serve as a mounting point for motor 146. This way, a propeller coupled to an outdrive attached to a motor 146 may remain submerged in water even as watercraft 100 is largely lifted out of the water (by, e.g., lift produced by ski 142 and/or any hydrofoils).

Figure 5:
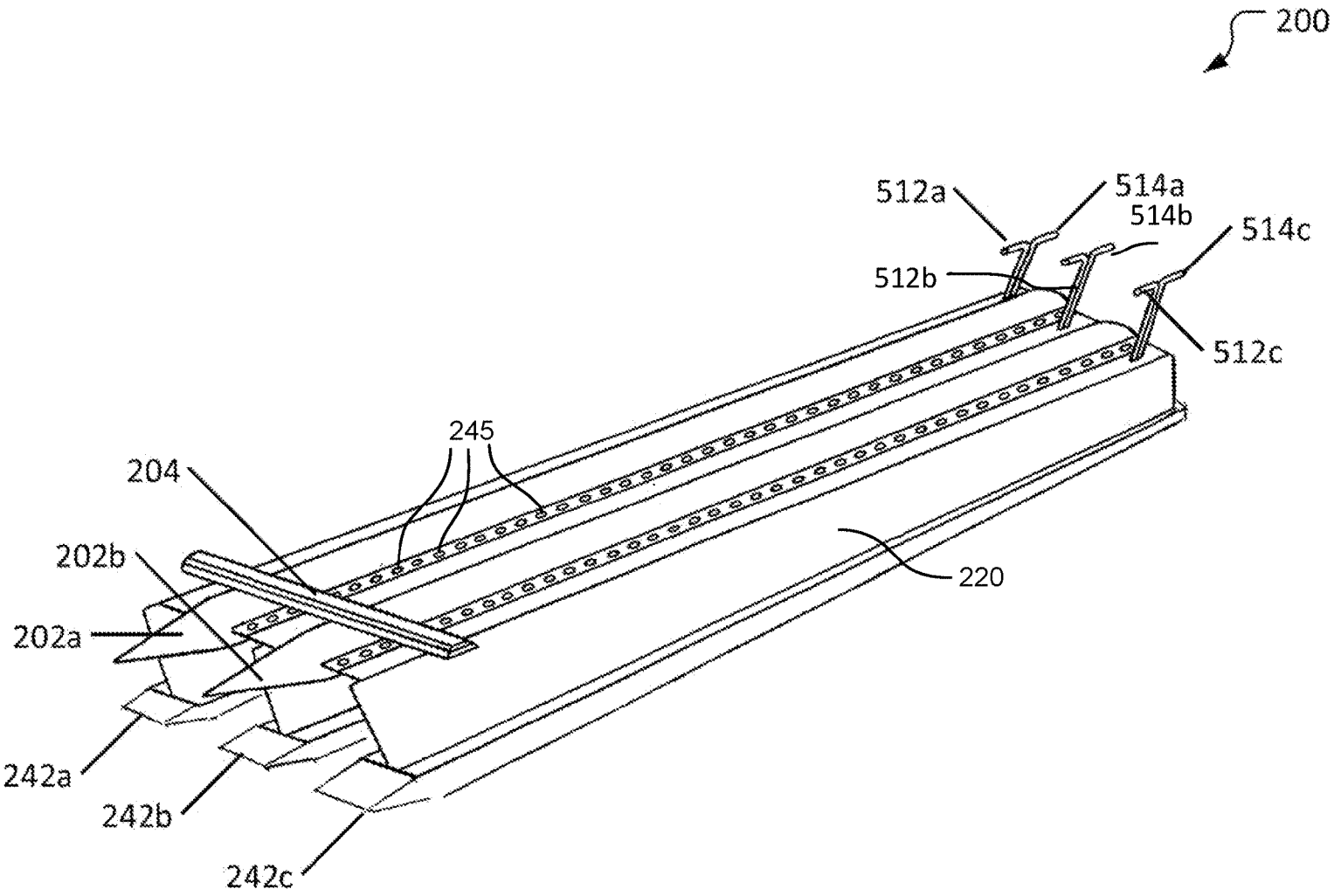
FIG. 5 illustrates a perspective view of a ski-borne passenger watercraft consistent with at least one embodiment of the present disclosure.
Figure 6:
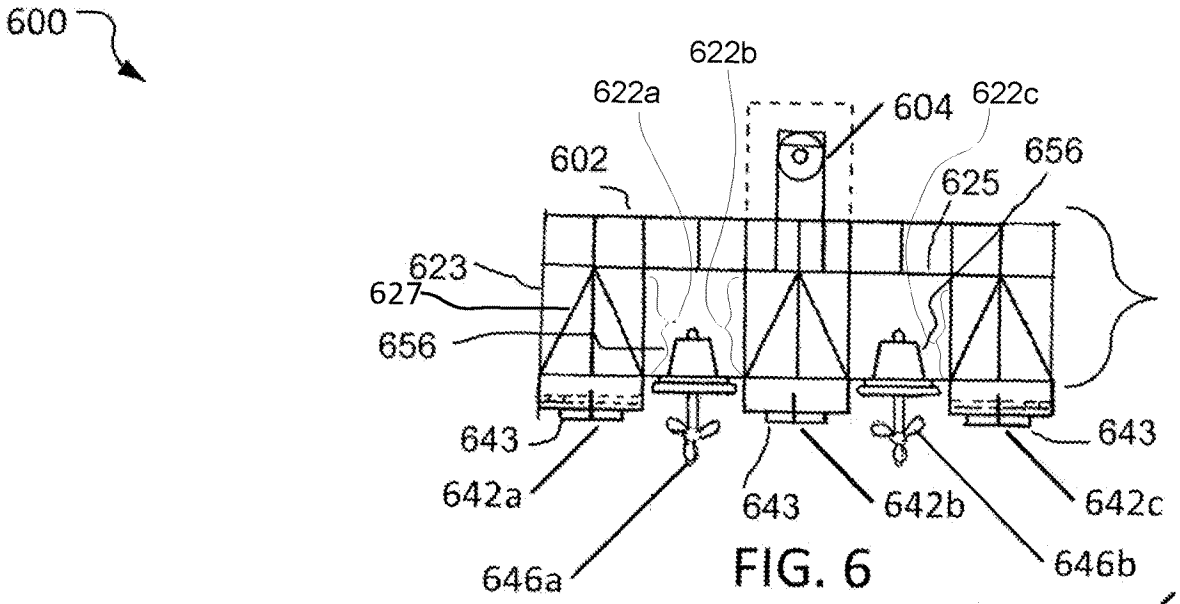
FIG. 6 illustrates a rear plan view of a ski-borne watercraft consistent with an additional embodiment of the present disclosure.

Dimensions of ski 142 and active planing surface may vary with embodiment, but as an illustrative example, a smaller passenger watercraft 600 as shown in FIG. 6 may include a ski 142 with a length of thirty-two feet or less. Alternatively, a large, over 500-passenger-capacity watercraft 200 (as shown in FIG. 5) may include a ski with a length of four hundred feet or greater. As noted above, embodiments of intermediate sizes (e.g., ski length of forty-five feet, seventy feet, etc.) are also fully considered herein.

Width of ski 142 preferably may increase as watercraft 100 LOA increases. Wider skis may provide more roll stability and support additional weight of watercraft 100 at the cost of increased drag and thus reduced efficiency.

Body 102 rests on the lower horizontal TC 125, approximately one-third down each truss vertical strut fit between the trusses 122. The top of the truss complex, the TC, goes through middle of body to middle truss. Truss members 124 may include horizontal and vertical struts, as well as diagonal members Preferably all truss members 124 are made of the same material, with a light weight and high tensile strength. A braking plate 808 may be included at the front part of the craft and may provide lift to the front of the ski 142, thus increasing the angle to the water of the whole ski 142, thus further braking the craft by ski 142 (and all skis). The angle created between the water surface and the ski 142 may be acute in degree. Each ski may have a braking plate and in such embodiments, each braking plate may be applied in unison to prevent frame stress.

Figure 2:
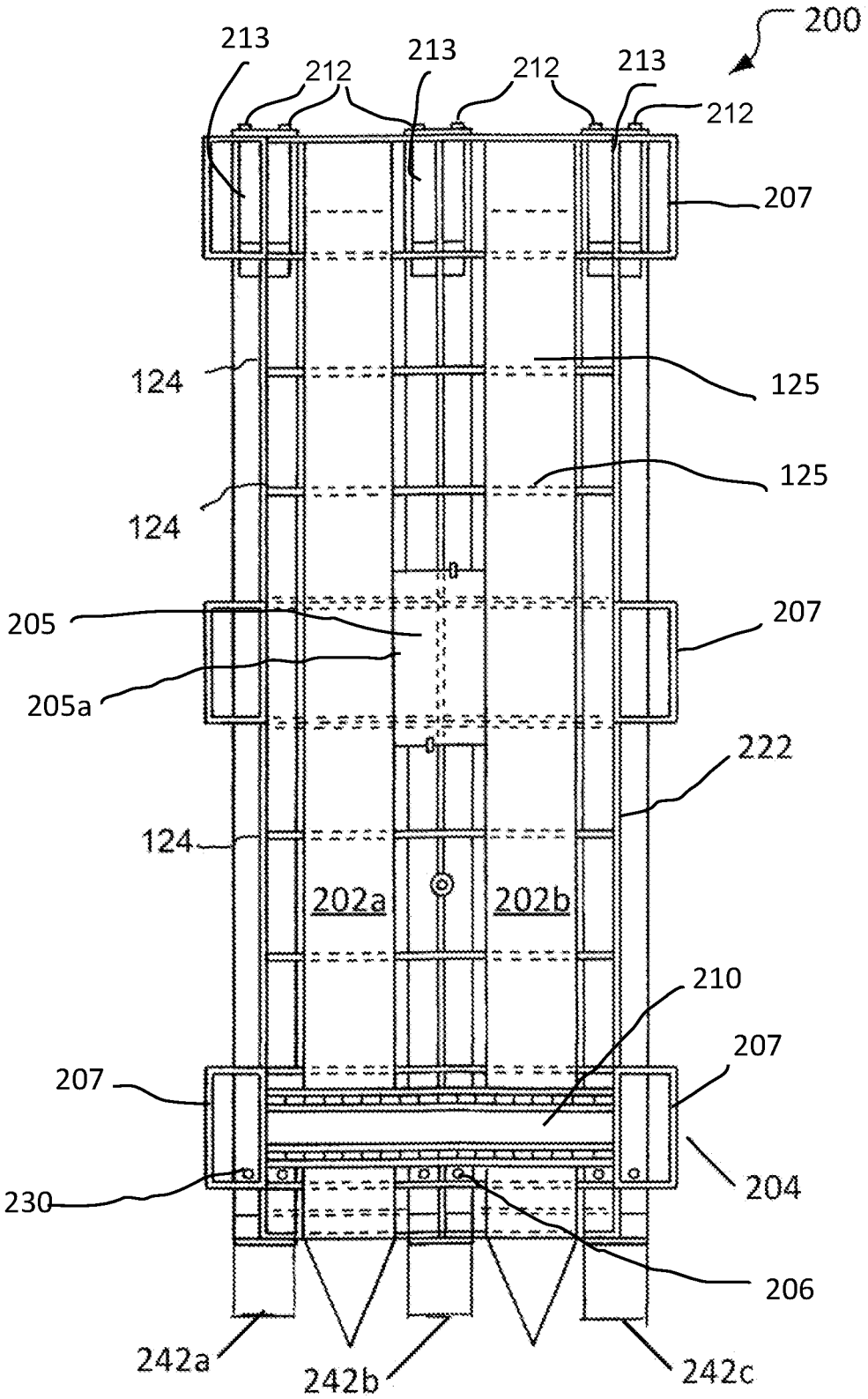
FIG. 2 illustrates an elevation view of a ski-borne freight watercraft consistent with at least one embodiment of the present disclosure.

FIG. 2 illustrates an elevation view of a ski-borne watercraft 200 consistent with at least one embodiment of the present disclosure. Watercraft 200 can be seen to be similar to watercraft 100 of FIG. 1, but FIG. 2 also depicts multiple bodies 202*a* and 202*b* ("bodies 202") and skis 242*a*, 242*b* and 242*c* ("skis 242"). In addition, truss structure 222 is shown to interconnect bodies 202 and skis 242. Vertical truss members 124 may support bodies 202*a-b* on top of skis 242*a-c*, coupling bodies 202*a-b* to skis 242*a-c*. FIG. 2 also shows that cabin 204 may span across bodies 202*a-b*, aiding in securing bodies 202*a-b* together. Note that in some embodiments, watercraft 200 may have even more skis 242*a-c* (e.g., possibly 4, 5 or more). Each ski 242*a,b,c* may have a corresponding truss structure 222 to secure it to bodies 202*a-b* and/or other skis 242*a-c*. Truss connecting members (TCs) 125 are shown as partially hidden beneath bodies 202*a-b*. Diesel engine 205 may provide electricity from generating room 205*a*. Dock bumpers 207 may be provided for docking and may be preferably attached at height of body 202*a,b* and upper horizontal truss members 124. Brake hydraulic units 230 may provide for braking and docking. A bridge 210 may be provided to house seamen and crew, as well in the lower floor in the bodies. Motor pods 212 may be provided at back/aft of skis for propulsion, powered by engines, and set near truss vertical truss members 124 for support, shown near right and left truss members 124.

In some embodiments, watercraft 200 may include a truss structure 222 set above and connecting with skis 242*a-c*. For example, while some frame structures may support the weight of bodies 202*a-b* on skis 242*a-c* by including truss members 124 that are at least partially vertical, other TCs 125 may prevent skis 242*a-c* from drifting apart from each other via trusses 222 with truss members 124 parallel to the plane of the body of water over which watercraft 200 travels. In some embodiments, ski connecting TCs 125 may be planar but not parallel to the plane of the water. Instead, some truss structures 222 may be at an angle (e.g., an angle of 45°, 15° or greater, 5° or greater, etc.) with respect to the plane of the water. The truss 222 may be centered above the center of the ski 242*a-c*.

Truss structure 222 may generally include at least one vertical support strut, or vertical support member, extending vertically from a top of the lower truss tube. This support member may be centered with respect to port and starboard of the ski 242.

It is contemplated that when actively moving/planing, the truss connection in the center of the truss and ski cannot be relied upon to prevent rocking/rolling of ski on bottom of truss. Strap 224 is set at approximately ninety degrees to truss bottom (e.g. relative to water level, ski top surface). Steel strap 224 is preferably one quarter-inch by three-inches with the lower portion attached to the ski upper side, preferably at outer edge of ski. Steel strap 224 stabilizes the ski 242 against rolling/twisting as the truss attachments in the center of the ski 242 (to the bottom of the truss) cannot be relied on to prevent rolling torsion forces. Straps 224 may relieve torsional stress when attached to a point at which a vertical truss support member 124 attaches to the ski 242. It is contemplated that, when actively moving, planing will be conducted at less than one degree from horizontal.

Figure 10:
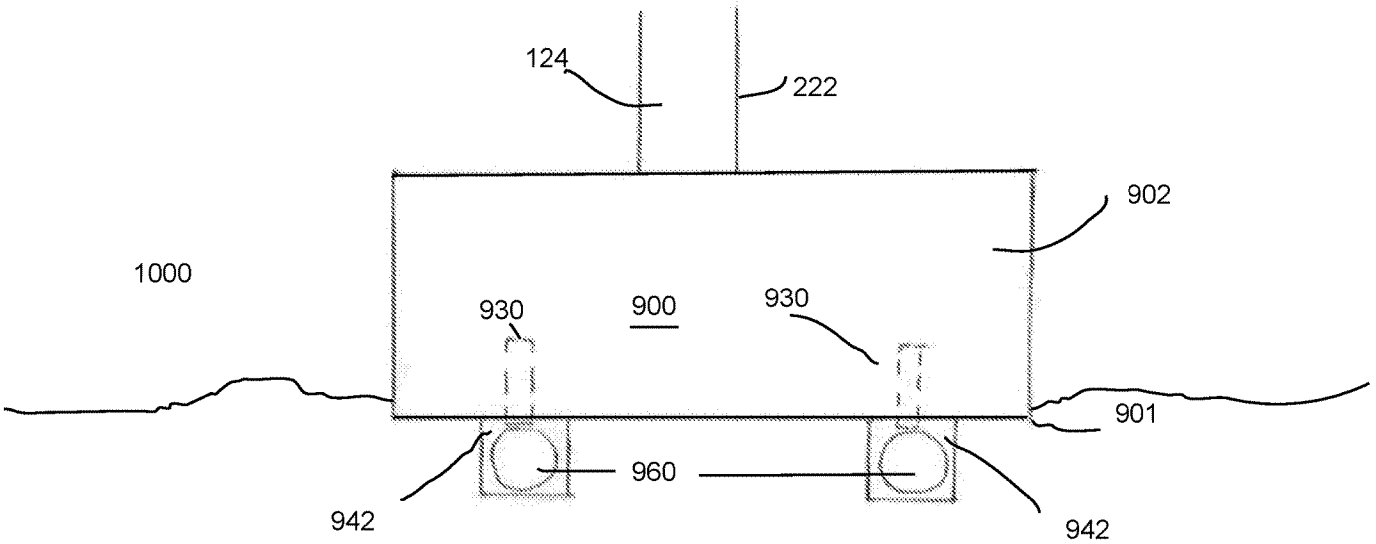
FIG. 10 illustrates a rear plan view of the back end of the ski and pod of an embodiment of the invention.
Figure 11:
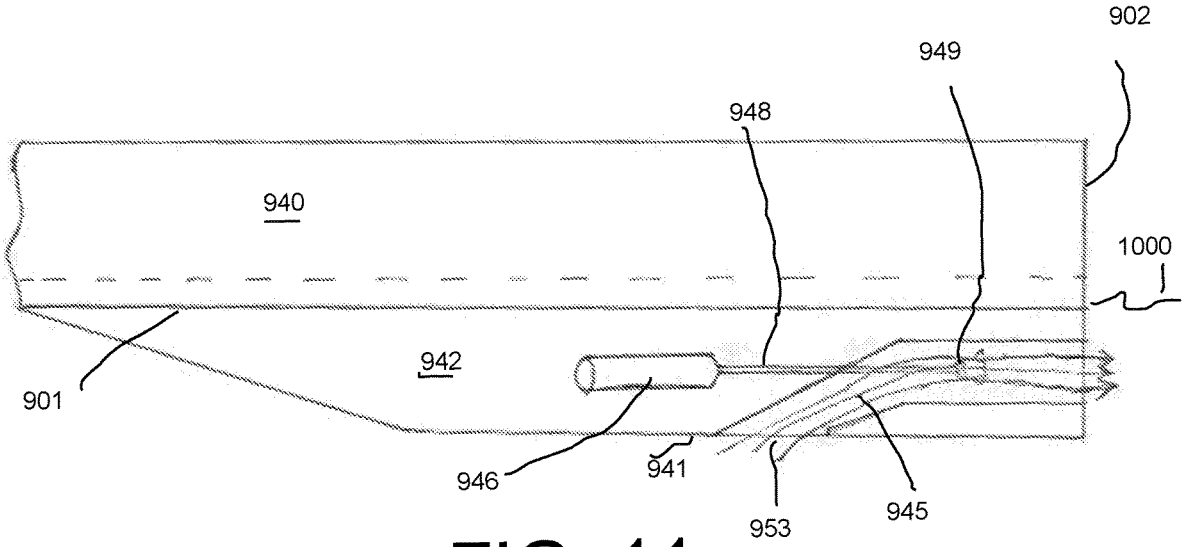
FIG. 11 illustrates a cross-sectional side view of the back end of the ski and pod of an embodiment of the invention.
Figure 12:
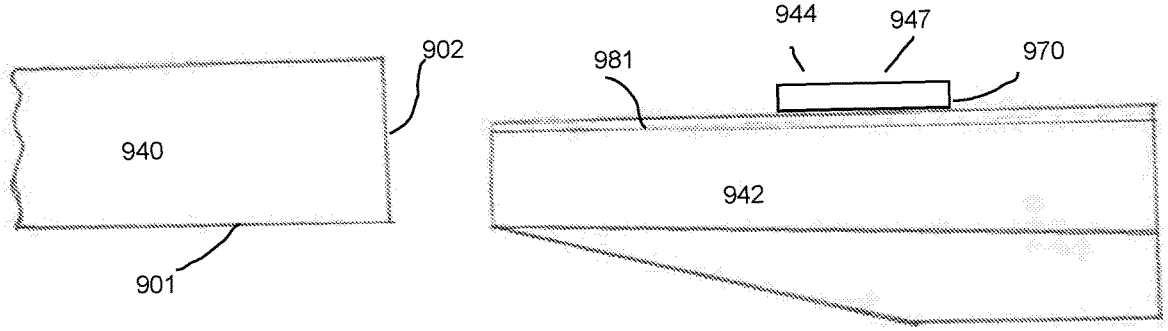
FIG. 12 illustrates a disassembled side view of the back end of a ski and pod of an embodiment of the present invention.
Figure 13:
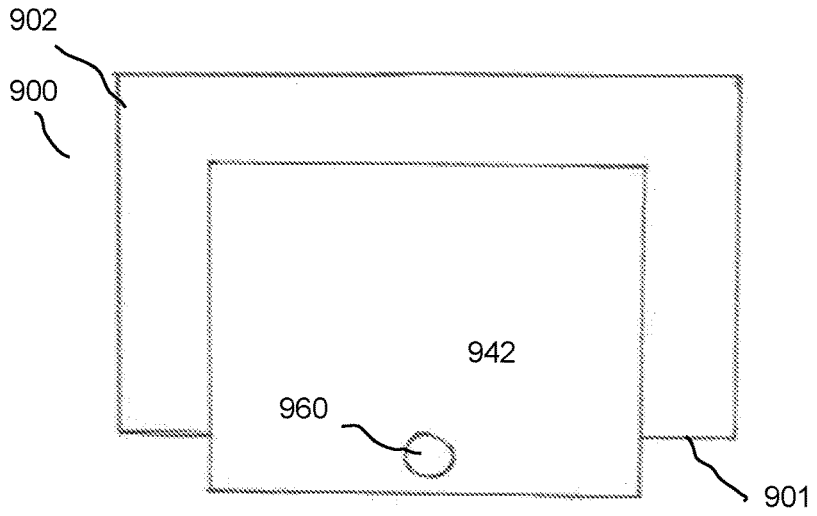
FIG. 13 illustrates a rear view of a ski with pod attached embodiment of the present invention.
Figure 14:
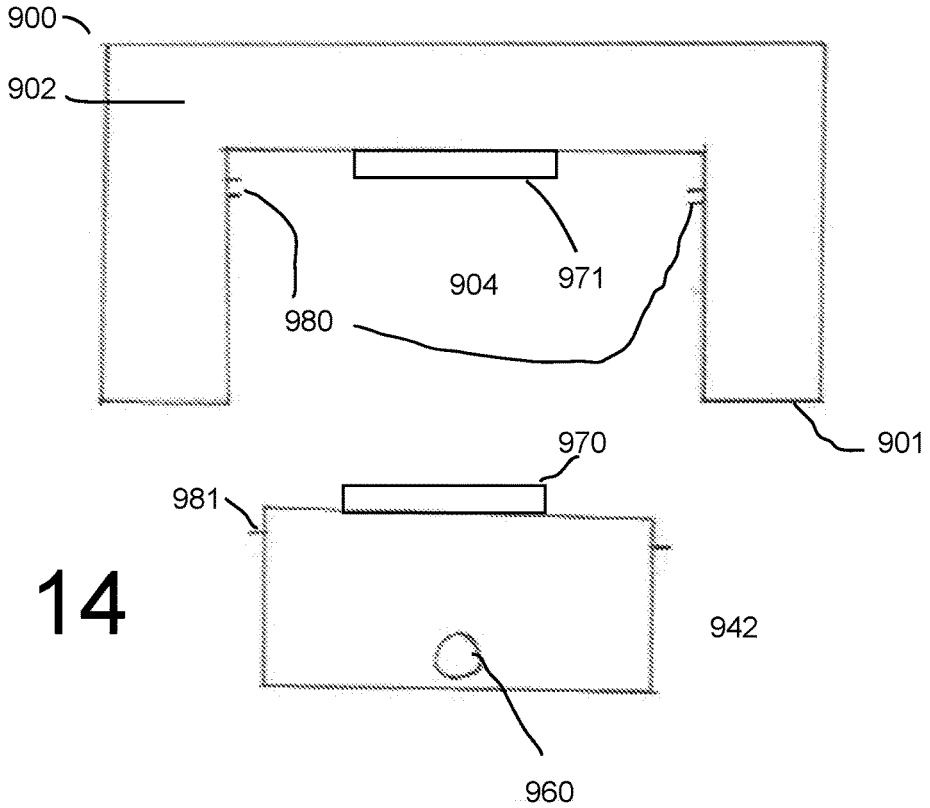
FIG. 14 illustrates a rear view of a disassembled ski and pod embodiment of the present invention.

In larger embodiments as those shown in FIG. 9-14 or otherwise, ski 900 may be arranged with an internal motor 946. Motors 946 may be lowered into skis 900 through motor holes 947 and outfitted with caps 944 on top of ski. Drop-in unit may be bolted onto an internal frame. Other portions of ski 900 may be used to store fuel and maintenance staff, etc. Cap 944 ensures the water proofing/sealing of the motor hole 947. Referring to FIGS. 9, 10, 13, and 14, water jet ski outlet 960 may provide a jet stream that may emanate below ski lower surface 943 and provide propulsion of vehicle below water surface 1000 when vehicle is in motion and planing. Motor 946 may drive shaft 948 to drive propeller 949 to pull water in inlet 953 on bottom of ski 900, forcing water through channel 945 and provide exiting fluid out of water jet ski outlet 960 on back end of ski 900. Water jet ski outlet 960 is adapted to provide for steering of vehicle by rotating, often in a horizontal plane, to provide for steering, or as otherwise known in the art of ski-propelled water craft. Each ski 900 may be outfitted with one water jet ski outlet 960 (as shown) or more than one water jet ski outlet 960. As shown in FIG. 10, two motor pods 942 may be installed on a single ski 900. With three skis 900 on vehicle, and two motors 946 per ski 900, a total of six water jet ski outlets 960 would be used. Alternatively, skis 900 may be placed against one another wherein the surface of the skis extends laterally across vehicle port to starboard. Ski 900 includes lower surface 901 which is meant to be at, or slightly below surface of water 1000 towards rear end 902 of ski 900. Motor pod 942 may extend below ski lower surface 901 so that water jet ski outlet 960 and inlet 953 on bottom of motor pod 942 are set below surface of water 1000. Motor pod 942 may also be installed entirely within the ski 900, with the water jet ski outlet 960 protruding from the ski rear end 902. Pins 930 may be positioned and slid in place to secure pod in position relative ski 900 when installed. Complementary slots may be used to secure the pins 930 in place.

The motor and pump may be located in a changeable/removable motor pod 942 attached to the rear end 902 of the ski 900. Motor 946 may be fitted to the ski 900, or otherwise power can be provided from engine 205 in generating room 205*a* to power shaft 948. Water flows through inlet 953 at bottom of ski 900, through impeller (not shown, driven by shaft 948 rotation) and out a water jet ski outlet 960. Pod 942 may be slid into rear of ski 900 along ski track 980 and motor pod track 981. Tracks 980 and 981 on ski 900 and motor pod 942, respectively, may create a complementary slide track to allow motor pod 942 to be installed. Plates may secure motor pod 942 in place once installed. When access is required to motor 946 in motor pod 942 when motor pod 942 is installed and vehicle is waterborne, coinciding ports may be set within ski recess 904. This allows one to exit from ski 900 down into motor pod 942 to access motor 946 for maintenance, removal/installation, etc. Servicemen may enter into top of pod, through maintenance portal, either directly, or from within rear portion of ski through a bottom surface of ski over pod. Gaskets 970 and 971 may fit on motor pod 942 and ski 900, respectively, to provide a seal to prevent flooding of motor pod 942 when accessed. Gaskets may include a hollow square or hollow round as known in the art with at least two-foot diameter, or 2'×2' (if square) space opening therebetween to allow serviceman vertical passage, or more preferably six-foot by eight-foot access portal similar to a small elevator, or larger as in use for a freight elevator to allow drop and lift of equipment into pod and/or ski through portal. Gaskets 970 and 971 may be inflatable to provide the seal and otherwise make a minimal profile so as not to interfere with motor pod 942 installation. Cap 944 may be placed above motor hole 947 to otherwise seal motor pod 942. Upper motor hole (not shown) in ski recess 904 is obscured by gasket 971. Gaskets 970 and 971 may be rectangular, square, or otherwise rounded in shape, so long as they are complementary to allow for sealing. In some embodiments, only one gasket may be needed, and it may be preferably located on the pod. It is contemplated that work may be done on the motor 946, in a shop when it is removed and re-installed via motor hole 947.

Figure 3:
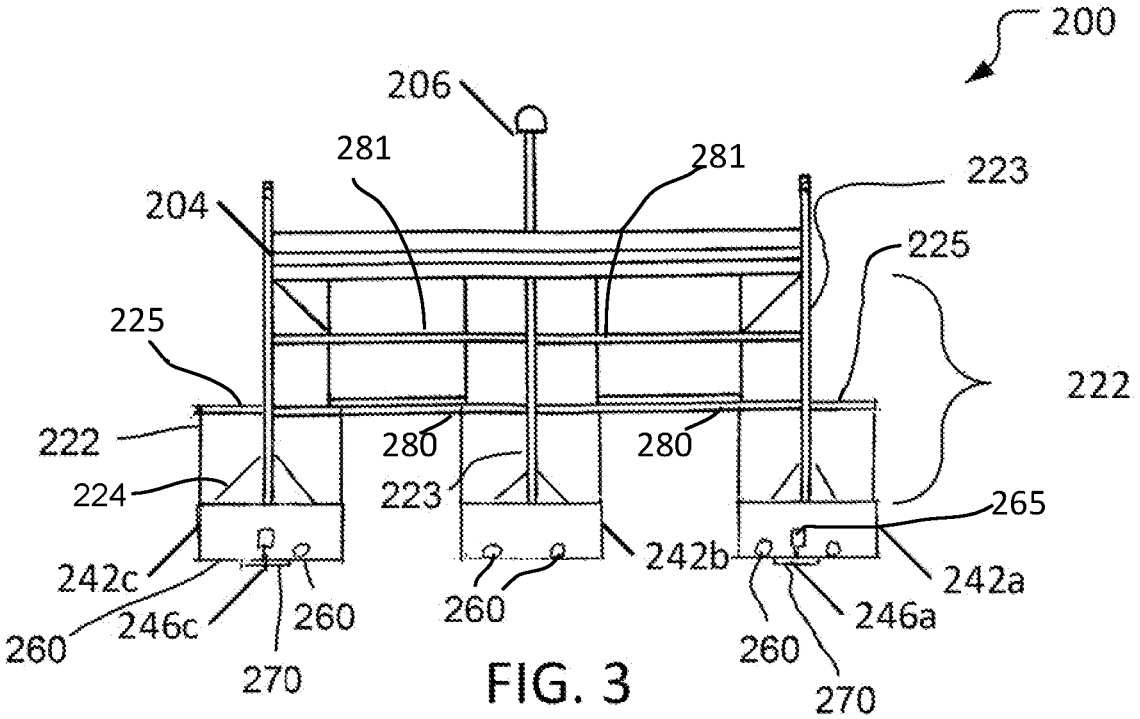
FIG. 3 illustrates a rear plan view of a ski-borne freight watercraft consistent with at least one embodiment of the present disclosure.

FIG. 3 illustrates a rear plan view of a ski-borne watercraft 200 consistent with at least one embodiment of the present disclosure. FIG. 3 depicts watercraft 200 from the aft. FIG. 3 trim tab 246*a,c* depicts in motion angle of the propulsion means used to propel the watercraft 200. Trim tabs 246*a,c* may be engaged to alter the angle of propulsion means via a hinge mechanism. Additionally, two motors 212*a* and 212*b* may be held above skis 242*a-c* via truss structure 222. In some embodiments each motor pod is mounted to a corresponding ski 242*a-c*, however, in smaller embodiments fewer motors 212*a-b* (one or two) may be necessary (here shown with two motors). Motors 212*a-b* and pumps (not shown) in motor pods 213 used along the back of the skis 242*a-c* may allow propulsion of the vehicle by emitting high-speed jetted water from the outlets below the bottom of each ski 242. An electronic communication array 206 may be located above cabin 204.

Hydraulic actuator 265 is provided for propulsion and steering. Trim tabs 246*a* and 246*c* may be provided to assist in planing and may be set on rear of skis 242. Trim tabs 246*a,c* may alternatively be placed in the air and attached to the watercraft 200 and/or structural frame and/or body 202 to provide aerodynamic spoiling, and help fine tune orientation of watercraft 200.

Ski 242 may be outfitted with brakes 260 that may be deployed on lower side of ski 242. Brakes 260 may rotatably deploy and orient to capture and brake moving vehicle. Ski tip 143 may also include a nose-in prevention, to rectify a scenario where skis 242 achieve a negative angle from horizontal, causing the nose of the watercraft 200 to point downward.

Figure 4:
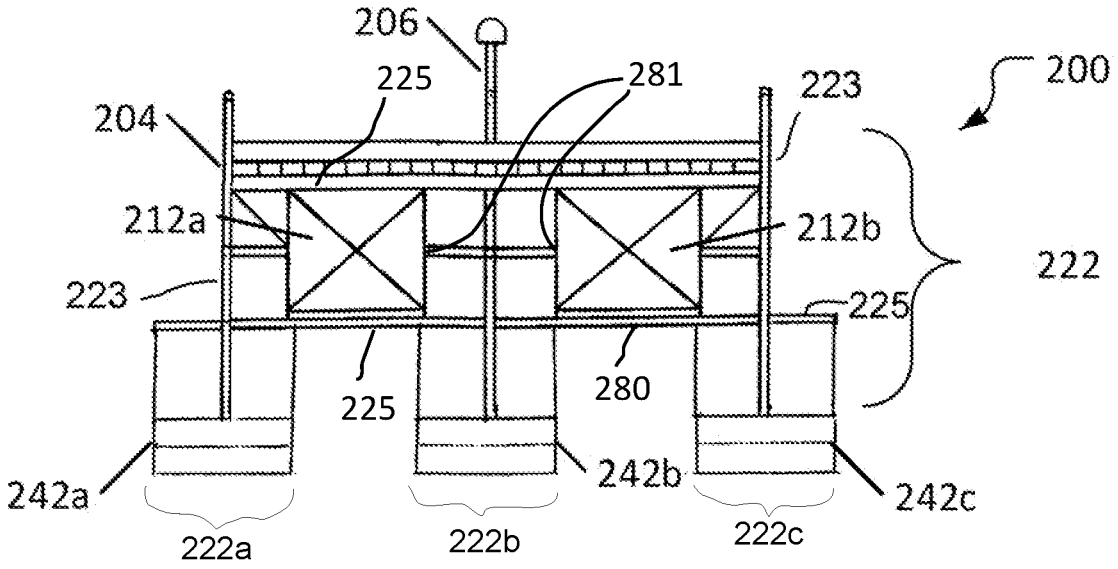
FIG. 4 illustrates a front plan view of a ski-borne freight watercraft consistent with at least one embodiment of the present disclosure.

FIG. 4 illustrates a front plan view of a ski-borne watercraft 200 consistent with at least one embodiment of the present disclosure. FIG. 4 depicts watercraft 200 from the stern, including skis 242*a-c*, truss structure 222, motor boxes 212*a-b*, cabin 204, and electronic communications array 206. Truss structure 222 may include vertical struts 223 and horizontal bars 225, in addition to the diagonal truss members (not shown). Horizontal bars 225 may be used to join adjacent skis 242 (and related vertical struts 223). Horizontal truss connectors 225 may serve as supports to bottom of bodies 202 at body lower surface 280. Alternatively, or in combination, horizontal truss connectors 225 may run through bodies 202 at truss support point 281 to support bodies 202, and possibly support a second, or other, floor in body 202. Truss support points 281 may occur at any point where a horizontal truss connector 225 comes into contact with a supported structure, such as a body 202, or a bridge 210.

Large passenger craft embodiment, shown in FIG. 5 may include exhaust 514*a-c* for rear engines, and air intakes 512*a-c*. Bridge 204 may be present. A side wall 220 may be used to shield truss structure 222, either on the side of truss structure 222, or encompassing it. Truss structure 222 may be set upon skis 242*a-c*. Body 202*a-b* may rest on truss structure 222 and provide passenger compartment areas with windows 245.

Figure 7:
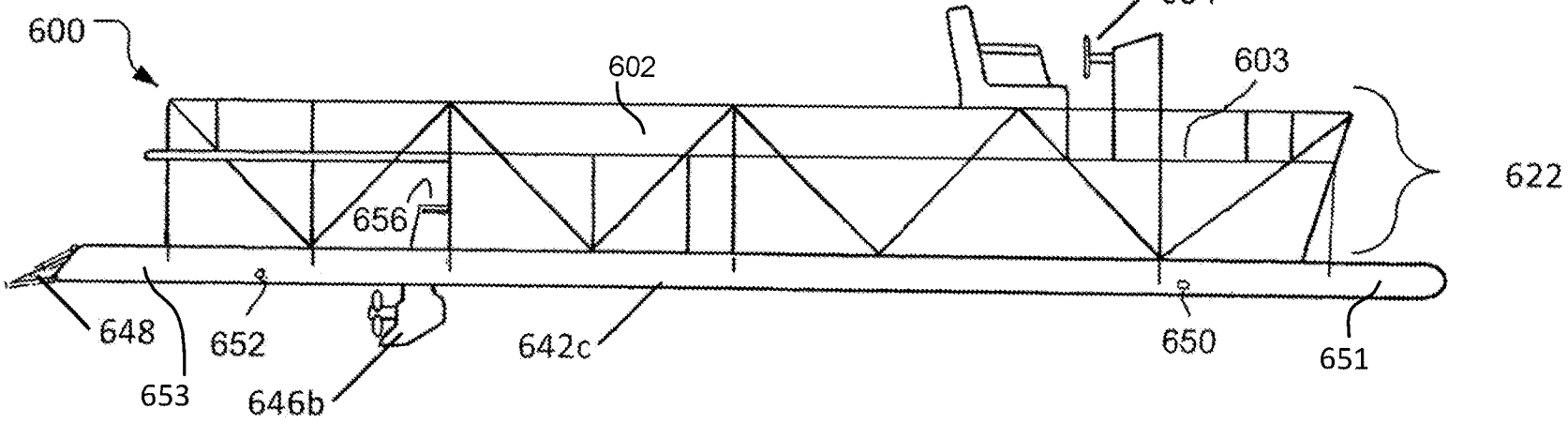
FIG. 7 illustrates a side plan view of a small ski-borne watercraft consistent with at least one embodiment of the present disclosure.

FIG. 6-7 illustrates a plan view of a small passenger watercraft 600 consistent with an additional embodiment of the present disclosure. FIG. 6 is an aft view of small passenger watercraft 600. Small passenger watercraft 600 may generally include one or multiple bodies 602 supported by skis 642*a-c* via truss 622. Motors, optionally contained in motor boxes 656, may be situated between and above skis 642 to avoid contact with water. Propellers 646 are associated with each of motor boxes 656 set between the skis 642. Between the skis 642, a motor box 656 may be placed with a portion of the motor box 656 extending below the water line. Each ski 642 may be equipped with a trim tab 643 along or near the back end of the bottom of the ski 642. Brakes (not shown) may be positioned along or near front of the bottom of each ski. Truss system 622 may include vertical struts 623 that may join each ski 642 at the edge (left or right), middle, or other portion of ski 642 to provide symmetric placement on ski 642. Horizontal bars as truss connectors 625 may be used to adjoin vertical struts 623 or truss systems 622 of parallel skis 642. Straps 627 may be used to stabilize skis 642 and form diagonal bars to brace or suspend from a point at the center of body 602 between the skis to equidistant locations from a center line of the ski and run along a plane perpendicular to the longitudinal axis of the ski to stabilize the lower two-thirds section of the truss systems 622. Small passenger watercraft 600 may be considered a better solution for craft smaller than watercraft 200 (above). For example, small passenger watercraft 600 may have a LOA of twenty-five feet with thirty- to thirty-two-foot skis and may have a passenger capacity of five to twenty (i.e., if configured to provide for them). Small passenger watercraft 600 may include control station 604 for an operator to control throttle of propeller 646. In some embodiments, small passenger watercraft 600 may support additional passengers, for example of with an additional two rows of seating (see drawing of skis) added behind control station 604 and one row in front. Skis 642 may be made of materials such as fiberglass, foam, etc. (Each one 2' of lumber; bottom ¾" plywood, top ½" plywood-all fiber glass.) Truss structure 622 may have a height of, for example, six feet or smaller. The center point of motor box 622 may preferably lie between trusses 622. Motor boxes 656 may be fully supported by one or more horizontal truss connecting members 625. Outdrives 648 are mounted on a transom in the rear of motor box 656 and connected to propellers 646. Outdrives 648 may be located on a platform between the skis 642 which is the bottom of the motor box 656. The motor box 656 may be set above the level of the skis 642. Outdrives 648 may rotate or pivot when steering is turned so as to steer moving craft.

FIG. 7 illustrates a plan view of a small passenger watercraft 600 consistent with at least one embodiment of the present disclosure. FIG. 7 depicts small passenger watercraft 600 from starboard, showing a more detailed view of control station 604 as well as truss system 622. Truss system 622 may include vertical struts 623 and diagonal members 624, as shown, to provide proper support for body 602. Other longitudinal truss members 603 may also be used to support body 602 and reinforce truss structure 622. As can be seen in FIG. 7, ski 642*c* may include an adjustable pivoting outdrive 648. Motor box 656 may be fastened to a corner of adjacent ski and situated over ski 642 and extend over an adjacent ski at top of ski, between, or on top of skis. Motor box 656 preferably includes a point (such as a triangle or irregular pentagon when viewed from above), or narrow corner at front to minimize air resistance as the vehicle travels forward. Motor within motor box 656 is not shown. Thrusters, both stern 650 and aft 652, may be used to dock vehicle via lateral forces perpendicular to the ski on the outside edge of the skis 642*a* and 642*c*, thrusting only out and away from side.

Small passenger watercraft 600 may additionally include a braking plate (not shown), controllable by an operator of small passenger watercraft 600. The braking plate may be connected to one or more of skis 642 via, for example, one or more hinges. The braking plate may be controlled to extend or fold away from skis 642 into the body of water, resulting in a braking action. This may, for example, enable an operator of small passenger watercraft 600 to quickly reduce speed. A rudder set behind one of the skis 642 may be used to steer the watercraft 600. A rudder may not be needed when the outdrive 648 is capable of pivoting to steer. Outdrive 648 pivot control may be provided to a steering wheel 658 to turn craft. Similarly, braking plate may act as nose pin preventer, and include automated activation when pitch of skis 642 drops and small passenger watercraft 600 points nose down at negative angle relative to water surface.

Water transfer tanks may be employed to balance vehicle, wherein one or more reversible pumps may be employed to move water within body 602 between rear water transfer tank 653 and front water transfer tank 651 to maintain a level vehicle, preferred once planing. Front water transfer tank 651 and rear water transfer tank 653 may be located within the body 602 or within the longitudinal ski 642.

Figure 8:
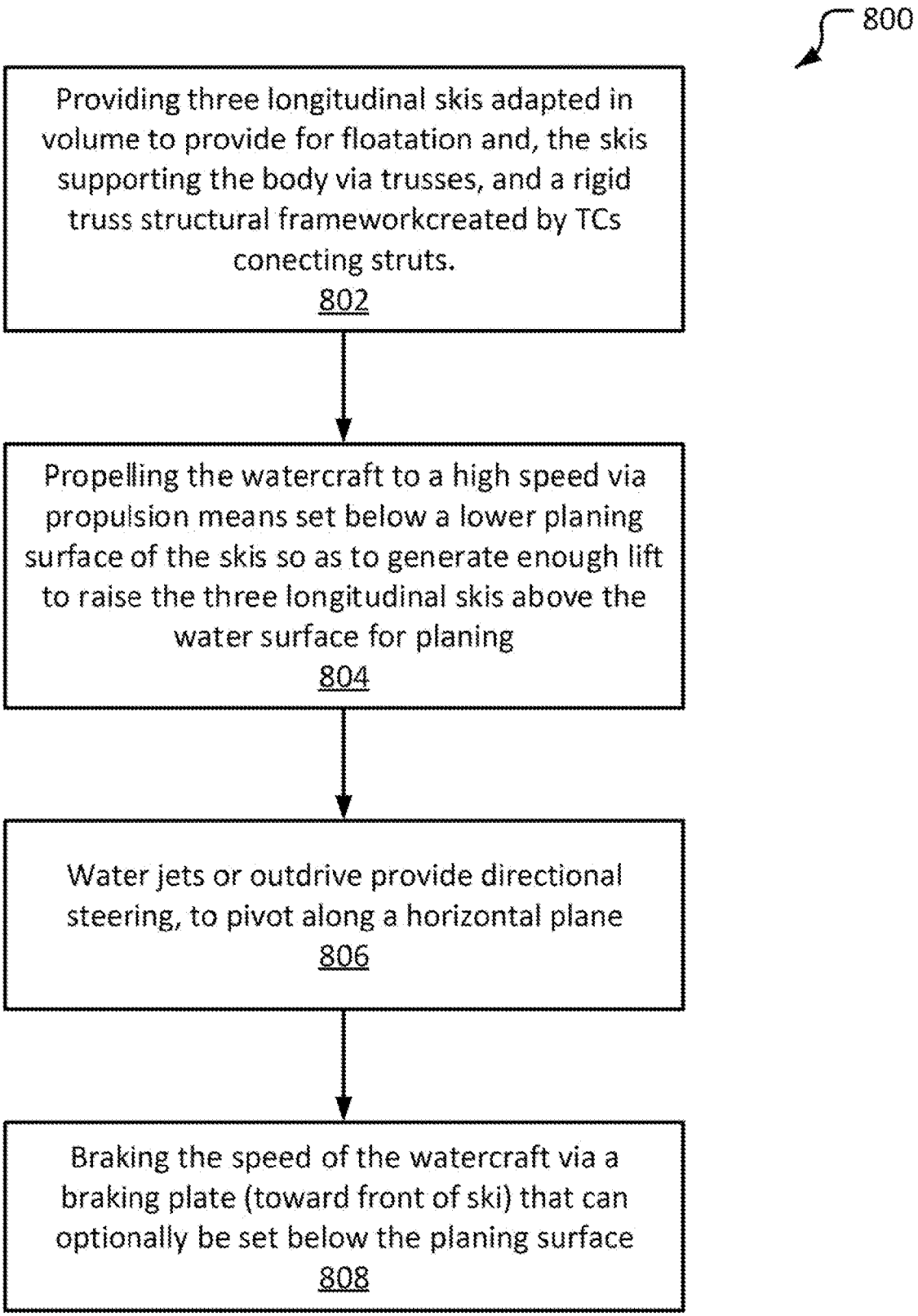
FIG. 8 illustrates operations according to one embodiment of the present disclosure.
Figure 9:
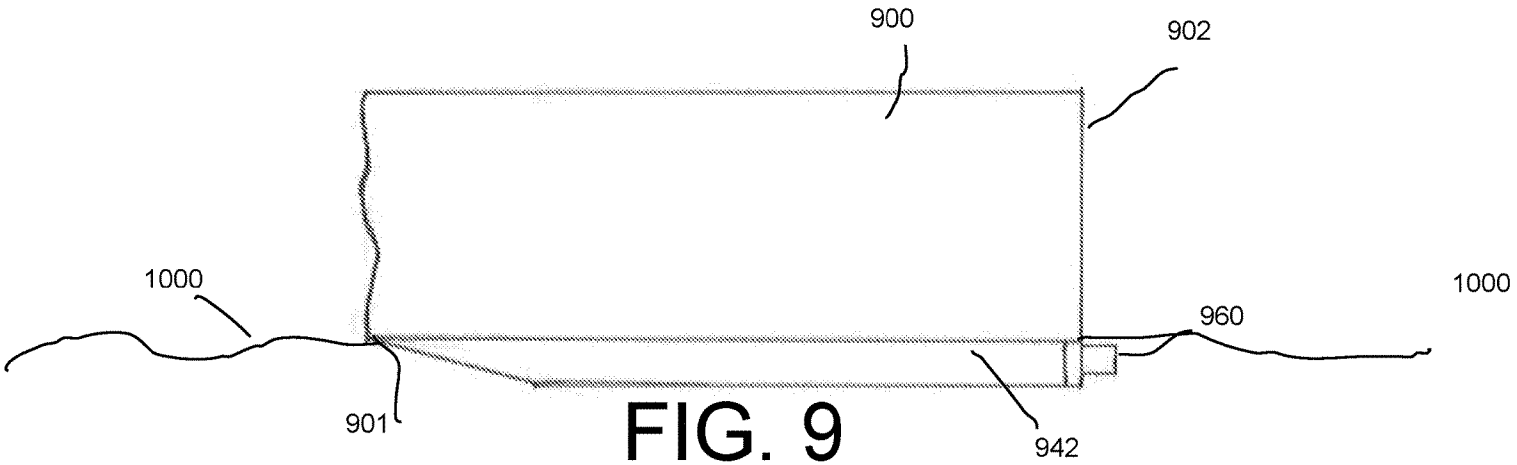
FIG. 9 illustrates a side view of the back end of the skis of an embodiment of the invention.

FIG. 8 illustrates operations 800 according to one embodiment of the present disclosure. Operations 800 according to this embodiment include providing at least three longitudinal skis adapted in volume to provide for floatation and maintenance of a watercraft body via trusses 802. Rigid structural framework is created by the two main truss connecting members set on each of the truss vertical members, and truss connectors as between skis 802. Operations 800 further include propelling the watercraft to a high speed via propulsion means set below a lower planing surface of the skis so as to generate enough lift to raise the longitudinal skis above the water surface for planing 804. Propelling the watercraft to a high speed via propulsion means set below a lower planing surface of the skis, or emanating in the back as in a jet ski, so as to generate lift when the craft is propelled forward, and raising the skis above the water surface. Water jets may be directional and include pivoting or rotating nozzles (along a horizontal plane) to provide for steering 806. Water jets or outdrive may also provide upward and downward steering as a trim function. Operations 800 may also include braking the speed of the watercraft via a braking plate (toward the front of the ski) that can optionally be set below the planing surface below the bow area of the skis 808.

In one embodiment, a bridge 210 or body 202 may rest on a lower truss connecting member 125 set between the middle truss 222*b* and starboard truss 222*c* and another bridge 210 or body 202 may rest between the port truss 222*a* and middle truss 222*b* to stiffen the structural framework. This truss and connecting framework prevent the planing surfaces of the skis 242 from achieving different planing angles. The strength of this framework may also be enhanced by the use of 'X' braces connecting the lower two-thirds of the truss vertical strut 223 to the same place in the adjacent truss, if 'X' brace would not tend to buckle from waves or hits from waves.

The large square footage of the planing surface on the bottom of the skis may allow the craft to be less sunken into the water by its loaded weight. The craft planing surface remains closer to the water surface which may allow for easier acceleration from launching to planing. The large planing surface may only push the water down where a normal watercraft or boat may move the water to either side of a center spine along the keel. The present invention may diminish the amount/number of waves created such that no or very small waves are created, which is ideal for river and coastal straightaway navigation. A curved river and coastal area or fog may require reduced speeds. An additional attribute may be the uniquely appropriate application to shallow waters, with a shallow draft or use in beach landings.

The truss structures described herein generally include a plurality of horizontal, vertical, and diagonal struts, or members. The motors may be any of a plurality of commonly available customer-off-the-shelf motors or engines, as will be appreciated by one of ordinary skill in the art. For larger embodiments (e.g., the watercraft of FIGS. 1-5), the propulsion may include diesel engines for driving generators. The electric motors may be generally configured to drive propulsion means (water jet pump, etc.) in order to exert thrust upon the watercraft. The motors and pumps may be located inside the pods and back of ski.

The body or bodies may comprise any of a plurality of commonly known features, including a deck, surface, etc. In some embodiments, the watercraft may include an elevator, staircase, ladder, or other means to enable one or more passengers to traverse from a ski to an upper surface of the body (e.g., a deck). Vertical members, such as struts, can be used in a truss in which they strengthen the complex. Diagonals in the truss structure may be referred to herein as webbing, and may connect to the truss with two truss connecting members per each truss vertical strut to form a rigid structural frame encompassing the top one-third of the truss bodies to sit between the truss resting on the bottom truss connectors with the top horizontal truss connector running through the middle of the body. Water pumps may pivot laterally to provide steering mechanism and up and down for trim adjustment.

For larger watercraft it may be adequate for water tanks 651 and 653 to be half-full and located in the front and back of each ski with a connecting waterline and two-way transfer pump that would also be used for trim purposes.

For the purposes of the present disclosure, the term "propulsion means" refers to any one of the above-described modes of propulsion, including propeller-driven, jet propulsion, water jet pumps, hydraulic actuator, marine gas turbine, water pump, etc. powered as described above, including by electric, marine gas, or diesel, whether in a motor pod or otherwise attached, as described above.

What is claimed is:

1. A truss-supported ski-borne watercraft, comprising:

a. at least one body having a deck and surface;

b. a first horizontal longitudinal ski set below the at least one body and at least a first vertical truss support member, said first horizontal longitudinal ski supporting a watercraft via a truss comprising:

i. said first vertical truss support member, and ii. a first diagonal support member;

c. a platform set above a top surface of said first horizontal longitudinal ski, said platform supporting at least a first motor in a motor box;

d. a second horizontal longitudinal ski below said at least one body, said second horizontal longitudinal ski supporting the at least one body via at least a second vertical truss support member, and a second diagonal support member, said second horizontal longitudinal ski positioned starboard, relative to first horizontal longitudinal ski, and further coupled to said first horizontal longitudinal ski via a truss connecting member, wherein said at least one body is at least partially supported by said truss connecting member;

e. wherein said first and second horizontal longitudinal skis comprise a height, a thickness and a width, creating a volume, wherein a combined displacement of water from said volume is sufficient to support the at least one body above water when the watercraft is loaded at rest; and f. a propulsion means for propelling the watercraft, said propulsion means powerful enough to provide lift to raise said first and second horizontal longitudinal skis above a water surface, each of said first and second horizontal longitudinal skis comprising a lower planing surface adapted to mate with the water surface and to support said watercraft and provide for planing against the water surface and wherein when planing, a propeller mechanically coupled to said motor box remains below said lower planing surface.

2. The truss-supported ski-borne watercraft of claim 1 wherein said platform is set between said first horizontal longitudinal ski and said second horizontal longitudinal ski and fully supported by one or more tubular truss connecting members.

3. A truss-supported ski-borne watercraft, comprising:

a. at least one body having a deck and surface;

b. a first horizontal longitudinal ski set below the at least one body and at least a first vertical truss support member connecting said at least one body and said first horizontal longitudinal ski, said first horizontal longitudinal ski supporting a watercraft via said first vertical truss support member, said first vertical truss support member and a first diagonal support member comprising a truss;

c. a second horizontal longitudinal ski set below said at least one body and supporting the watercraft via at least a second vertical truss support member, and a second diagonal support member, said second horizontal longitudinal ski positioned starboard relative to first horizontal longitudinal ski and further coupled to said first horizontal longitudinal ski via a horizontal truss connecting member, wherein said at least one body is at least partially supported by said horizontal truss connecting member;

d. at least a first motor system, said motor system providing power to a water jet pump positioned to supply forward propulsion to said watercraft via at least one means for propulsion with at least a portion of said propulsion means set below the lower planing surface of said first horizontal longitudinal ski;

e. wherein said first and second horizontal longitudinal skis comprise a height, a thickness and a width defining a volume, wherein a combined displacement of water from said volume is sufficient to support the at least one body above water when the watercraft is loaded at rest; and f. a propulsion means for propelling the watercraft, said propulsion means powerful enough to provide enough lift to raise said first and second horizontal longitudinal skis above a right-angled water surface, each of said first and second horizontal longitudinal skis comprising a lower planing surface adapted to mate with the water surface and to support said watercraft and provide for planing against the water surface and wherein when planing, at least a portion of said propulsion means remains below said lower planing surface.

4. The truss-supported ski-borne watercraft of claim 3 wherein said at least first horizontal longitudinal ski comprises a round or pointed front end adapted to minimize water and/or wind resistance.

5. The truss-supported ski-borne watercraft of claim 3 wherein said second vertical support member is hollow and tubular and is centered above said second horizontal longitudinal ski as between port and starboard edges of said horizontal longitudinal ski.

6. The truss-supported ski-borne watercraft of claim 5 further comprising a third horizontal longitudinal ski below said at least one body and supporting said at least one body via at least a third vertical truss support member, and a third diagonal support member, said third horizontal longitudinal ski port of and further coupled to said first horizontal longitudinal ski via a third truss connecting member;

a. a strap set between said at least one body and a starboard surface of said second horizontal longitudinal ski; and b. another strap set between said at least one body and a port surface of said third horizontal longitudinal ski;

c. said strap and said another strap mounted to said vertical supports and adapted to prevent torsion of said truss at second and third horizontal longitudinal skis along a longitudinal axis.

7. The truss-supported ski-borne watercraft of claim 3 further comprising an adjustable propellor outdrive on a rear end of at least one of said first, second, and third horizontal longitudinal skis, said adjustable outdrive hingedly coupled to said at least one of said first and second horizontal longitudinal skis.

8. The truss-supported ski-borne watercraft of claim 3 further comprising a water jet pump outdrive rotatably coupled to at least one of said horizontal longitudinal skis to allow for turning of an exiting water stream.

9. The truss-supported ski-borne watercraft of claim 3 further comprising a first longitudinal tube and a second longitudinal tube, said first and second longitudinal tubes supported via trusses above said skis, said at least first one body mounted above and perpendicularly across said first and second longitudinal tubes.

10. The truss-supported ski-borne watercraft of claim 3 further comprising a trim tab device mounted to said at least one body.

11. The truss-supported ski-borne watercraft of claim 3 further comprising an aft-stern leveling means comprising a reversible pump adapted to move fluid within said first longitudinal ski from aft to stern, and vice-versa.

12. The truss-supported ski-borne watercraft of claim 3 wherein said motor and water jet pump are positioned within said first horizontal longitudinal ski or in a pod within said first horizontal longitudinal ski such that a water jet stream emerging from said water jet pump emerges below a water surface and below a bottom planing surface of the ski.

13. The truss supported ski-borne watercraft of claim 12 wherein said motor system is removable through a hole in said ski or said pod, wherein the hole is sealed by a gasket and closed with a cap.

14. The truss supported ski-borne watercraft of claim 13 wherein said hole in said pod at least two-foot in diameter.

15. The truss supported ski-borne watercraft of claim 13 wherein said the pod is installed into a rear of the ski along a ski track.

16. The truss-supported ski-borne watercraft of claim 3 further comprising at least one braking plate hingedly mounted to said first horizontal longitudinal ski, and adapted to extend below said lower planing surface so as to provide resistance against forward motion of the watercraft.

* * * * *